United States Patent [19]

Chow

[11] 4,056,582

[45] Nov. 1, 1977

[54] HUMIDIFIER ASSEMBLY

[75] Inventor: Ho Chow, River Edge, N.J.

[73] Assignee: Beatrice Foods Co., Chicago, Ill.

[21] Appl. No.: 693,377

[22] Filed: June 7, 1976

Related U.S. Application Data

[63] Continuation of Ser. No. 537,250, Dec. 30, 1974, abandoned.

[51] Int. Cl.[2] ..... B01F 3/04

[52] U.S. Cl. ..... 261/30; 126/113; 261/92; 261/DIG. 15

[58] Field of Search ..... 261/30, 92, DIG. 15, 261/91, 28; 126/113

[56] References Cited

U.S. PATENT DOCUMENTS

| | | | |
|---|---|---|---|
| 3,021,831 | 2/1962 | Byrge | 261/92 X |
| 3,105,860 | 10/1963 | Dunn | 261/DIG. 15 |
| 3,149,626 | 9/1964 | Wentling et al. | 261/DIG. 15 |
| 3,189,328 | 6/1965 | Hotchkiss et al. | 261/92 X |
| 3,274,993 | 9/1966 | Martin | 261/DIG. 15 |
| 3,385,574 | 5/1968 | Lohman | 261/DIG. 15 |
| 3,400,919 | 9/1968 | Schall | 261/DIG. 15 |
| 3,472,496 | 10/1969 | Coleman et al. | 261/DIG. 15 |
| 3,497,187 | 2/1970 | Skerritt | 261/92 |
| 3,537,692 | 11/1970 | Vick | 261/DIG. 15 |
| 3,599,942 | 8/1971 | Herr | 261/92 |
| 3,610,589 | 10/1971 | Paulin | 261/92 X |
| 3,621,830 | 11/1971 | Geisler et al. | 261/92 X |
| 3,659,581 | 5/1972 | Geisler et al. | 261/92 X |
| 3,724,824 | 4/1973 | Mitich | 261/92 |
| 3,774,588 | 11/1973 | Yeagle | 261/DIG. 15 |
| 3,814,393 | 6/1974 | Malmgren | 261/DIG. 15 |

*Primary Examiner*—Tim R. Miles
*Assistant Examiner*—Richard L. Chiesa
*Attorney, Agent, or Firm*—James & Franklin

[57] ABSTRACT

A versatile by-pass humidifier assembly utilizes the flow of air therethrough as the driving force to rotate a fluid carrier subassembly, but may also be adapted for use with an electric motor as the driving force. The water carrier subassembly has a unique "drop-in" design which permits easy removal and replacement, all without the use of tools or fasteners. Similarly, the fluid reservoir is removable for maintenance and cleaning and the cover is removable for access to the humidifier assembly interior, both being removable and replaceable without the use of tools or fasteners of any sort.

29 Claims, 13 Drawing Figures

9
9
8
8
A
B
C
D
12
16
18
19
20
20
22
24
26
28
30
40
42
52
54
56
58
71
72
74
78
80
82
83
83
84
102
105
106
111
112
126
127
135
135
154
173
173
173a
174
220

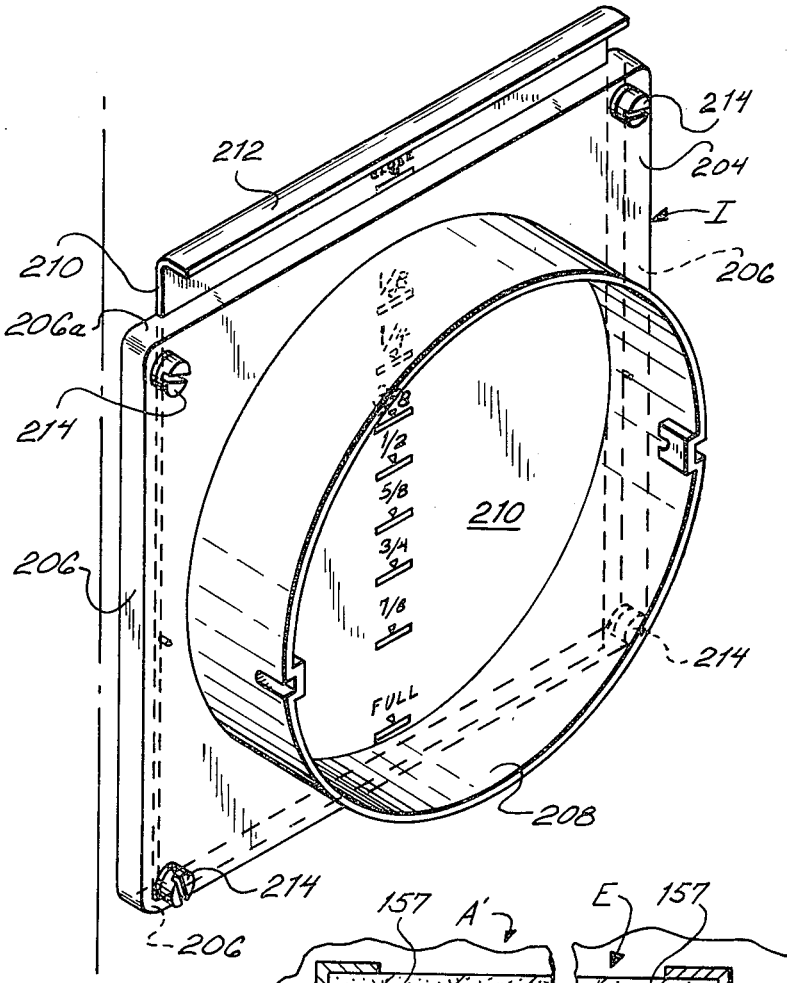
FIG. 10
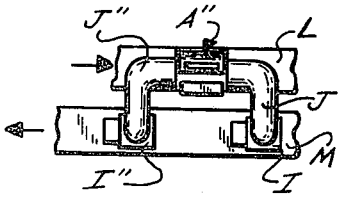
FIG. 12
FIG. 11
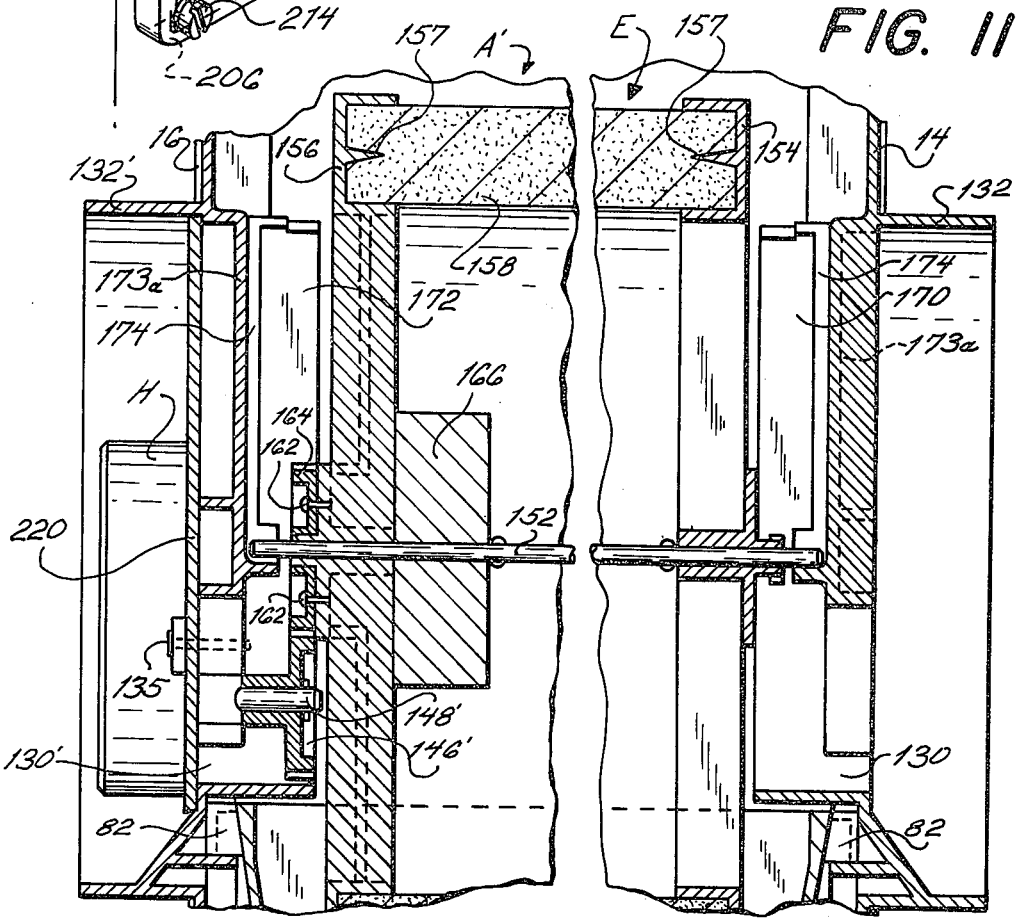

HUMIDIFIER ASSEMBLY

This is a continuation of application Ser. No. 537,250, filed Dec. 30, 1974 now abandoned.

BACKGROUND OF THE INVENTION

The present invention relates to humidifier assemblies having a rotating water carrier subassembly. The carrier subassembly contains a hydrophilic member which is moistened in a water reservoir at the base of the humidifier assembly and which transports the water into an air stream passing through the humidifier assembly. Inasmuch as the humidifier assemblies tend to be run constantly during the winter months, even the small but constant energy drain required to rotate the water carrier subassembly represents a needless drain on the energy supply of the nation and higher power charges for the user.

Many of the prior art humidifying devices are furthermore so constructed as to require the tedious complete disassembly of the entire humidifier from the associated hot air heating system in order to inspect, adjust, repair, clean or replace the humidifier's operating components. For example, despite the fact that the water reservoir must be frequently cleaned of accumulated impurities from the water supply such as dirt and rust, prior art devices of the type exemplified by U.S. Pat. No. 3,621,830 require complete removal of the humidifier assembly from the heating system in order to permit removal of the water reservoir for maintenance operations. The cover, which is used to close the opening through which the carrier subassembly is inserted into the internal chamber of the humidifier assembly, is frequently secured into the humidifier assembly by means of screws or other fasteners requiring adjustment or removal before the cover can be opened. Finally, removal and subsequent re-insertion of the water carrier subassembly typically requires the use of tools, or at least careful placement of the carrier subassembly within the humidifier assembly to assure its engagement with the mechanism used to cause rotation thereof.

Accordingly, it is an object of the present invention to provide a by-pass humidifier assembly which is powered by the air moving between the supply and return sides of a hot air furnace and which requires no electricity for operation.

Another object is provide such a humidifier subassembly in which the water carrier subassembly is of drop-in design and may be removed from the humidifier housing or placed in operating position therein without the use of tools or fasteners.

A further object is to provide such a humidifier assembly in which the reservoir is easily removable and replaceable without the use of tools or the need to work fasteners.

It is another object to provide such a humidifier assembly utilizing a cover which is easily removable and replaceable without the use of tools or the need to work fasteners.

It is also an object to provide such a humidifier assembly having an extremely versatile design so that the flexible duct connecting the humidifier assembly to the damper may be connected to either side of the humidifier assembly and the humidifier assembly may be easily adapted to electrical operation.

SUMMARY OF THE INVENTION

The foregoing and related objects of the present invention as obtained in a by-pass humidifier assembly which connects the hot air supply and cold air return sides of an associated hot air furnace. In the air-driven embodiment a portion of the air stream moves between the high pressure and low pressure return ducts through the humidifier and is used to drive the water carrier subassembly.

More particularly, the humidifier assembly according to the present invention comprises in its major structural aspects a housing assembly, an open topped reservoir slidably received in the housing assembly adjacent the base thereof for the storage of fluid, and a cover movably positioned on the housing assembly adjacent the top thereof. The housing assembly, the reservoir, and the cover cooperatively define an interior chamber for receipt of a fluid carrier subassembly removably positioned within the chamber so as to have a hydrophilic portion thereof contacting the fluid within the reservoir.

The cover acts as a top section of the housing assembly and is movable between top closing and top opening positions, the cover in the latter position defining an opening through which the fluid carrier subassembly can pass. When the cover is moved to the top-opening position, the carrier subassembly may simply be dropped through the opening into the chamber where automatically it operatively contacts a driving member adapted to rotate the carrier subassembly and thus brings fluid continually from the reservoir into the flow path of the air passing through the chamber. The means operatively connecting the driving member and the fluid carrier subassembly permit the fluid carrier subassembly to move freely from the aforementioned opening to its operating position and vice versa, the operative connecting means being active on the carrier subassembly when the latter is in its operating position, but ineffective to restrict movement of the carrier subassembly from that operating position. In the air-driven embodiment of the present invention, the motive force for the driving member is provided by a fan member situated in the air flow path, and in the electrically driven embodiment the motive force is provided by an electrically driven motor situated outside of the air flow path.

In a preferred embodiment of the present invention, the reservoir means, the carrier subassembly and the cover means are all removable from and replaceable on the housing assembly easily and without the use of tools or fasteners.

The cover means is preferably a convexly bowed sheet of resiliently flexible material having a forwardly facing flange at both ends. The housing assembly is provided with a top section having a downwardly extending flange and a front section having a rearwardly extending flange, the top and front section flanges being positioned to engage the cover means flanges and maintain the cover means in its passageway closing position. A simple "push-in and lift" motion directed at the base of the cover means frees the cover means flanges from the housing assembly flanges to permit easy removal of the cover means, thus exposing a passageway through which the fluid carrier subassembly may be removed.

The carrier subassembly preferably comprises a rotatable shaft, at least one hydrophilic member carried by and spaced from the carrier shaft for rotation therewith, and a gear mounted on the carrier shaft for rotation therewith. The end walls of the housing assembly include recesses which receive the end segments of the carrier shaft when the carrier subassembly is dropped into the housing assembly. Under the influence of gravity and directed by the slope of the recesses, the carrier subassembly drops to its operating position in which the bottom-most segment of the hydrophilic member lies below the water level of the reservoir, one end of the carrier shaft rests on the bottom of one recess, and the other end of the carrier shaft is supported—through its carrier gear—by the gear comprising the operative connecting means. Thus the fluid carrier subassembly is mounted in the housing assembly by means of structure permitting the fluid carrier subassembly to move freely between its operating position and the passageway of the housing assembly normally covered by the cover means. As the operative connecting means between the rotating drive means and the fluid carrier subassembly is simply a gear which is meshingly engaged from above by the gear of the carrier subassembly (under the influence of the weight of the carrier subassembly), the operative connecting means is active on the carrier subassembly when the latter is in its operating position, but ineffective to restrict upward movement of the carrier subassembly from its operating position towards the passageway.

The reservoir means is preferably of trough-like configuration and is slidably received in an opening in the front of the housing so that it is accessible at the front of the housing for easy removal and replacement, removal being accomplished with a simple "lift, pull-out, and drop" operation.

BRIEF DESCRIPTION OF THE DRAWING

FIG. 10 is an isometric view of a damper assembly used in conjunction with the humidifier assembly of FIG. 1, the furnace system duct upon which it is mounted being illustrated in phantom line;

FIG. 11 is a fragmentary front elevation view, partially in cross section, of an electrically-driven embodiment of a humidifier assembly according to the present invention;

FIG. 12 is a fragmentary elevation view illustrating a configuration for duct mounting a double by-pass embodiment of the humidifier assembly of the present invention, and its associated flexible duct and damper assemblies, on a hot air furnace system.

DETAILED DESCRIPTION OF THE PREFERRED EMBODIMENTS

Figure 1:
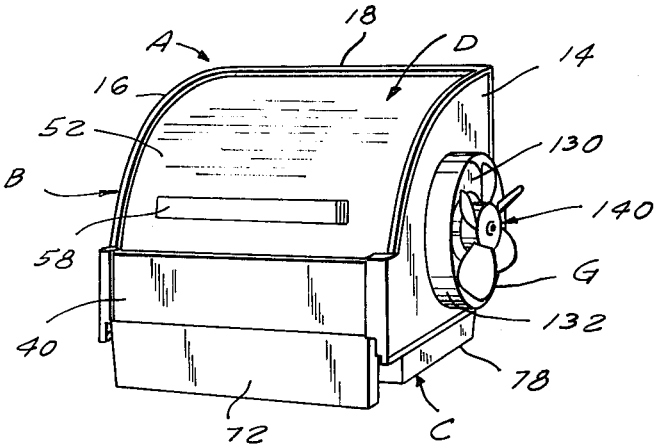
FIG. 1 is an isometric view of an air-driven embodiment of a humidifier assembly according to the present invention.

Referring now to the drawing and to FIG. 1 thereof in particular, the humidifier assembly A according to the present invention comprises in its major aspects a housing assembly B, an open topped reservoir C slidably received in the housing assembly B adjacent the base thereof for storage of fluid and accessible at the front of housing assembly B for removal and replacement, and a cover D forming a movable top section of the housing assembly B. The housing assembly B, the reservoir C, and the cover D cooperatively define an interior chamber for receipt of a rotatable fluid carrier subassembly E (see FIGS. 7–8) removably positioned within the chamber so as to have a hydrophilic portion thereof contacting the fluid within the reservoir C. When the cover D is moved to a top-opening position, the carrier subassembly E may simply be dropped into the chamber where automatically it operatively contacts a driving member F adapted to rotate the carrier subassembly E and thus bring fluid from reservoir C into the flow path of air passing through the chamber. In the air driven embodiment A of the present invention, the motive force for the driving member F is provided by a fan member G situated in the air flow path, while in the electrically driven embodiment A′ (see FIG. 11) the motive force is provided by an electrically driven motor H.

Referring now to FIGS. 2–5 in particular, the humidifier assembly A is utilized in conjunction with a damper assembly I and a flexible duct J which connects the damper assembly I and the humidifier assembly A. The humidifier assembly A and the damper assembly I are disposed on opposite sides of the furnace K of an associated hot air heating system. Preferably the humidifier assembly A is in gaseous communication with the cold air return duct L of the heating system, while the damper assembly I is in gaseous communication with the hot air supply duct M of the heating system. As the pressure of the air in the hot air supply duct M exceeds the pressure of the air in the cold air return duct L, a stream of hot air from the hot air duct M is diverted into the damper assembly I, through the flexible duct J, into the interior of the carrier subassembly E, the hot air stream (along with the moisture that is picked up from the carrier subassembly E) being eventually discharged into the cold air supply L. As the air blows past the fan member G it causes rotation of the fan member G and thus rotation of the carrier subassembly E which is linked to the fan member G through a gear.

More particularly illustrated in FIG. 1 is an air-driven humidifier assembly A according to the present invention. The humidifier assembly A includes a housing assembly B which defines a pair of oppositely disposed and spaced end supports or sidewalls 14 and 16 as well as a connecting or rear wall 18 extending between and connecting the sidewalls 14 and 16.

Figure 7:
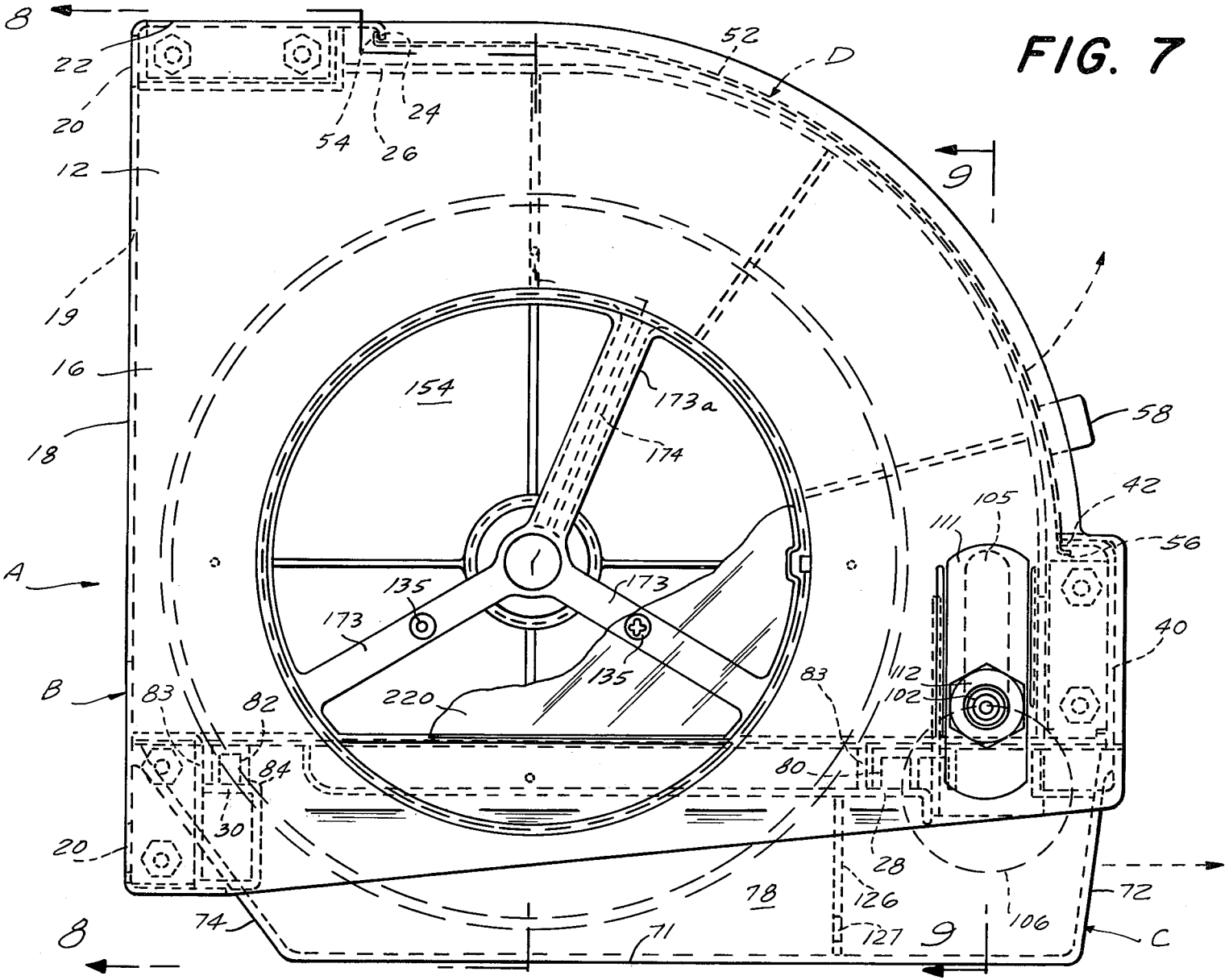
FIG. 7 is a left side elevation view of the humidifier assembly of FIG. 1, to a greatly enlarged scale and partially in cross section, with a portion of the window removed to reveal details of internal construction.
Figure 8:
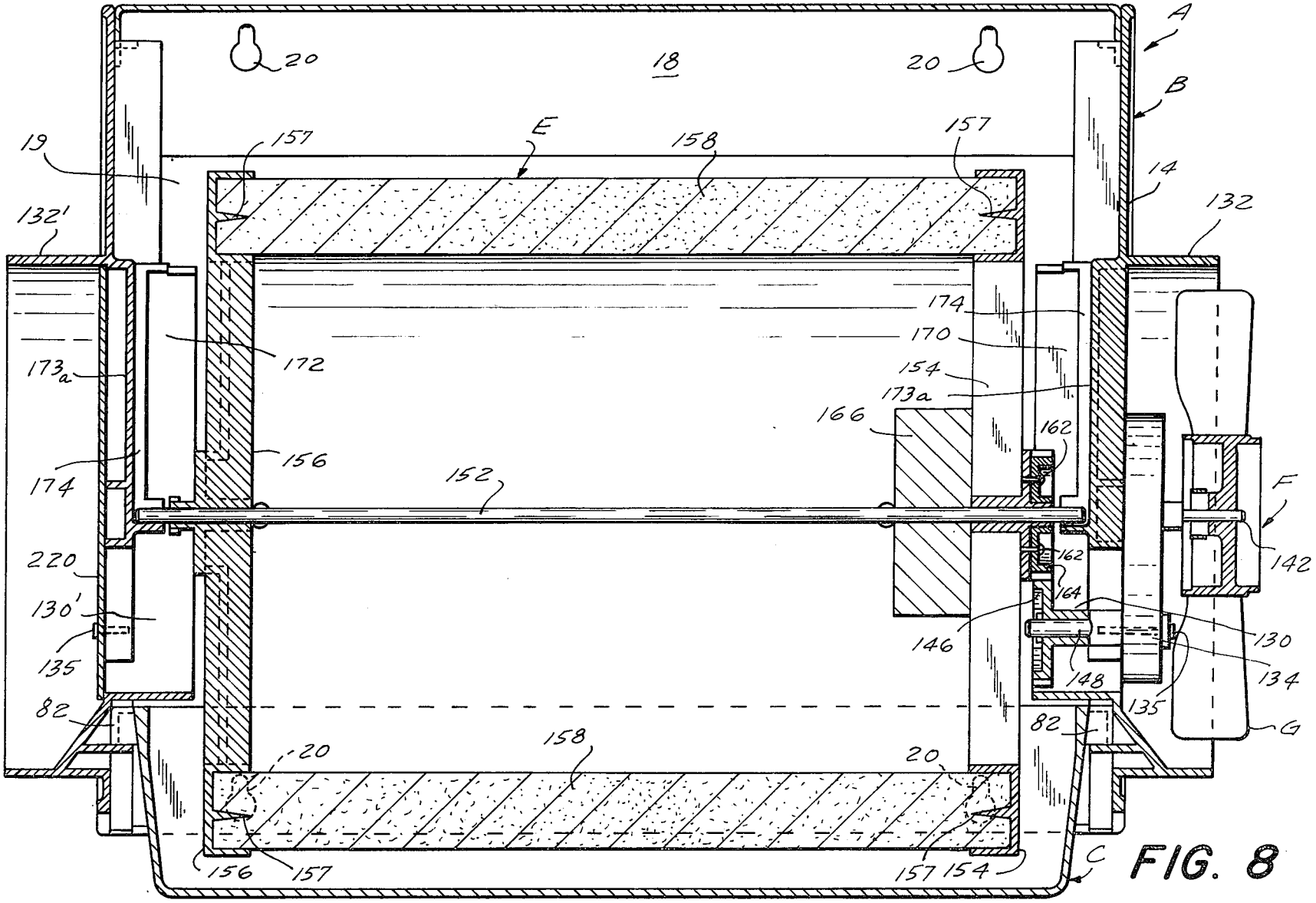
FIG. 8 is a front elevation view taken along the line 8—8 of FIG. 7.

Referring now in particular to FIGS. 7 and 8, the rear wall 18 defines a large central aperture 19 of rectangular configuration, a small keyhole aperture 20 adjacent each corner thereof for mounting purposes, and at the top thereof a forwardly extending flange 22 having a downwardly extending lip 24. Both of the sidewalls 14 and 16 are smoothly curved in their upper forward quadrant and define an inwardly extending lip 26 which is slightly set back from the smoothed curved outer surface. Adjacent the base of each sidewall 14, 16 are front and rear inwardly turned tab or bearing surfaces 28 and 30, respectively, the various bearing surfaces 28, 30 of the two sidewalls 14, 16 lying in a single horizontal plane, for purposes which will be described hereinafter. A narrow front wall 40 joins the sidewalls 14, 16 forwardly of and below the smoothed curved surfaces, the front wall 40 including a rearwardly directed lip 42 at the top thereof.

Referring now in particular to FIGS. 1 and 7, a cover D for the housing assembly B comprises a bowed sheet 52 of resilient material having an unstressed curvature slightly less than the curvature of the inwardly extending flanges 26 of the sidewalls 14, 16. The top end of the sheet 52 is provided with an upwardly turned lip 54, while the bottom end of sheet 52 is provided with an outwardly turned lip 56. When the cover sheet 52 is manually stressed and positioned in the housing assembly 12, its lips 54 and 56 overlap and engagingly press against the rear wall lip 24 and the front wall lip 42, respectively. As the natural tendency of the bowed sheet 52 is to straighten slightly to a less bowed orientation, the central portion of the sheet 52 will bear against a mid-portion of the flanges 26 of the sidewalls 14, 16 at the same time as lips 54, 56 at either end of the sheet 52 are engaging rear wall lip 24 and front wall lip 42, respectively. To facilitate removal of the cover D, a handle 58 is provided at the front thereof and adjacent the lower end. Thus, the cover D is easily removed from the housing assembly B by use of a "push-in and lift" motion. Pressure on the handle 58 directed towards the rear wall 18 causes a rearward retreat of the forwardly extending cover lower lip 56 from the rearwardly extending front wall lip 42, and a subsequent upward motion of the lower cover lip 56 relaxes the tension on the sheet 52 to a point where the upper lip 54 drops below the level of the downwardly extending rear wall lip 24, so that the entire cover D is easily removed without the need to undo screws or other fasteners. To reinsert the cover D, the upper cover lip 54 is first inserted behind the rear wall lip 24, and then the handle 58 is pressed inwardly and downwardly until lower cover lip 56 is below the level of the front wall lip 42. At this point the handle 58 will force the cover lower lip 56 under the front wall lip 42.

A reservoir C, preferably of generally trough-like configuration, comprises a relatively planar bottom 71, a substantially vertical front wall 72, an inclined rear wall 74, and a pair of essentially vertical sidewalls 78. Extending outwardly from each of the sidewalls 78 are a front tab 80 and a rear tab 82, the two forward tabs 80 and the two rear tabs 82 lying in a single horizontal plane. When the reservoir C is seated within the housing assembly B, the forward reservoir tabs 80 rest on the front bearing surfaces 28 of the sidewalls 14, 16, while the rear reservoir tabs 82 rest on the rear bearing surfaces 30 of the sidewalls 14, 16. A slight forward movement of the reservoir C causes the reservoir tabs 80, 82 to slide laterally along the sidewall bearing surfaces 28, 30 until they become laterally displaced from such bearing surfaces 28, 30. At this point the reservoir C is no longer vertically supported by the housing assembly 12 and drops free for easy removal. To remount the reservoir C in the housing assembly B, the reservoir C is simply positioned under the housing assembly B with the reservoir tabs 80, 82 forward of and below the sidewall bearing surfaces 28 and 30. The reservior C is then lifted until the reservoir tabs 80 and 82 are above the height of the sidewall bearing surfaces 28 and 30, respectively, at which point the reservoir C is laterally slid towards the rear of the housing assembly B. When the rear wall 74 of the reservoir C contacts the rear wall 18 of the housing assembly B, tabs 80, 82 will abut sidewall stops 83 to preclude further rearward motion. The reservoir C may now be released as the bearing surfaces 28, 30 are vertically supporting the tabs 80, 82 to maintain the reservoir C in place. As a safeguard against accidental dislocation of the reservoir C from the housing assembly B due to vibrations, each rear bearing surface 30 is desirably provided with a slight upward projection 84 at its forward edge, the projection 84 acting to preclude disengagement of the rear tabs 82 from the rear bearing surface 30 unless the forward motion of the reservoir C is accompanied by a slight upward motion of at least the rear of the reservoir C. Thus a simple "lift, pull-out and drop" operation is all that is required for removal of reservoir C, the lift to clear projections 84 and the pull-out to clear tabs 80, 82.

Figure 6:
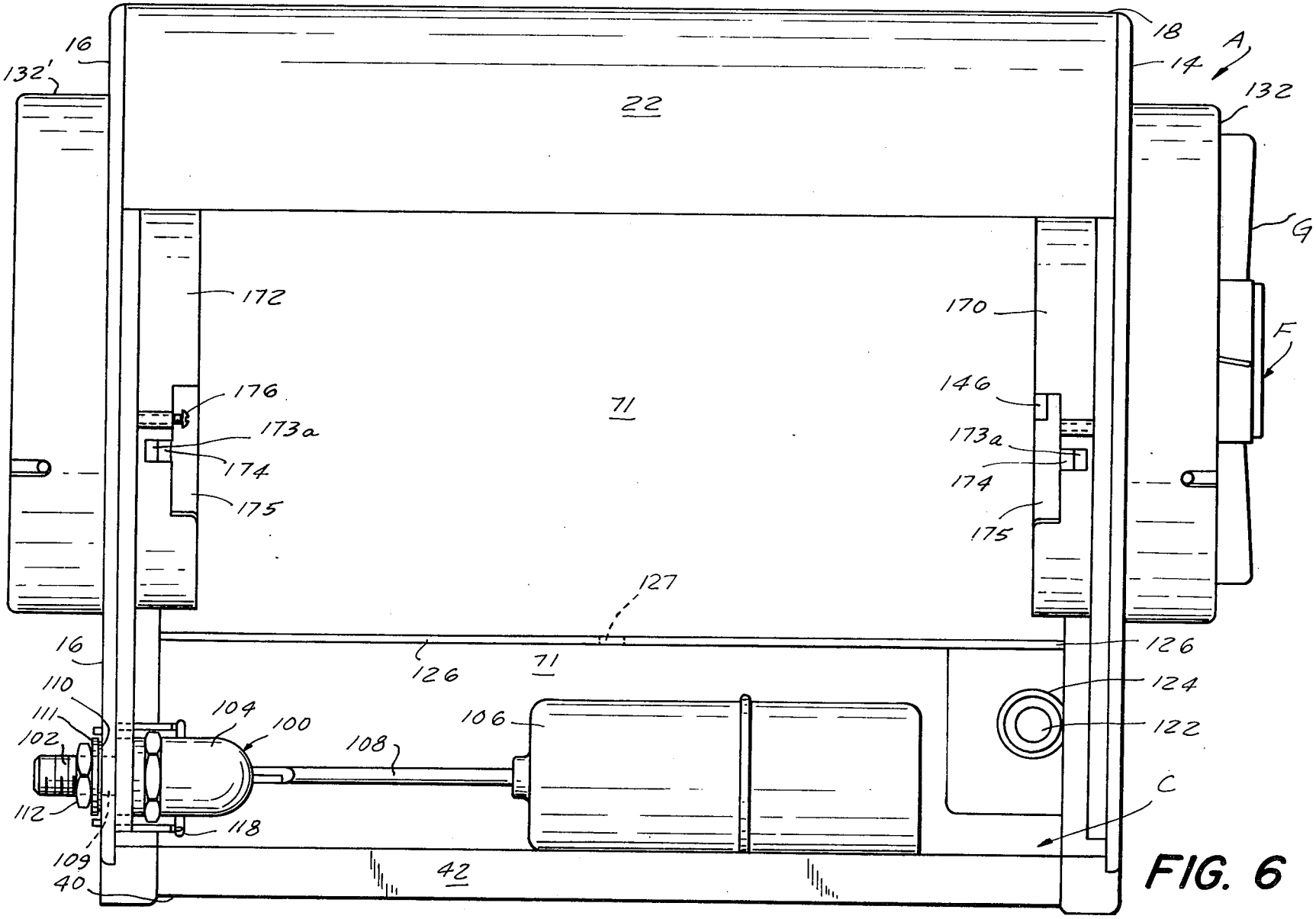
FIG. 6 is a top planar view of the humidifier assembly of FIG. 1, to a greatly enlarged scale, with the cover and water carrier subassembly removed to reveal details of internal construction.
Figure 9:
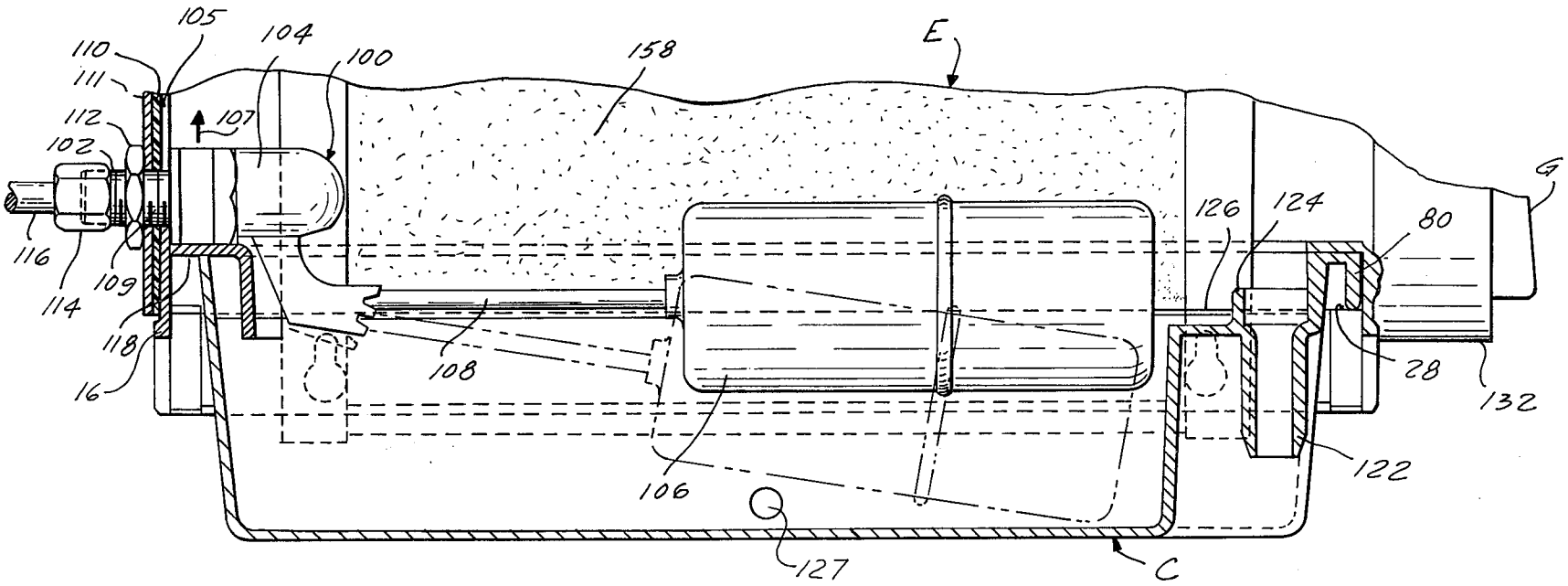
FIG. 9 is a fragmentary front elevation view taken along the line 9—9 of FIG. 7, and illustrating the humidifier assembly connected to a water supply.

Referring now in particular to FIGS. 6 and 9, maintenance of a desired fluid level within the reservoir C is accomplished by means of a float valve generally designated by the numeral 100 and comprising a water inlet tube 102 passing through sidewall 16, a shut-off valve 104, and a float 106 connected to valve 104 by a generally horizontally extending arm 108. One end of the water inlet tube 102 is secured within the float valve 104 while the threaded shank 109 thereof passes through sidewall 16 (to which it is secured by a water-tight gasket 110, a face plate 111, and a nut 112), and the other end thereof is threadingly adapted for engagement by the threaded connector 114 of a water supply 116 (see FIG. 9). As flange 118 extends inwardly from sidewall 16 and downwardly into the reservoir C to prevent water from splashing out of the reservoir C while the latter is being filled. When the fluid level in reservoir C is at the desired level, float 106 is normally horizontal, but its actual angle may be varied by moving the float valve 104 up or down along slot 105 in sidewall 16, as indicated by arrow 107 in FIG. 9, in order to maintain the same water level in the reservoir C for different water pressures. Float 106 acts through arm 108 to close the valve 104 and preclude the entry of further fluid into the reservoir C through the water inlet tube 102. As the fluid in reservoir C is depleted, the fluid level lowers, float 106 drops to a lower level (the position indicated in phantom line in FIG. 9), and the valve 104 opens to admit fluid from the fluid supply 116 into the reservoir C. The entering fluid raises the fluid level within reservoir C, causes float 106 to return to its normal position (typically horizontal, as indicated in solid line in FIG. 9), and thus closes the valve 104 to terminate entry of fluid through water inlet tube 102.

A vertically extending circular drainage channel 122 is provided in the front right portion (as seen in FIGS. 6 and 9) of reservoir C. When the fluid level in reservoir C exceeds the height of the upstanding weir 124—but before the fluid level reaches the top of reservoir walls 72, 74 and 78—the excess fluid overflows weir 124, is drained through channel 122, and is hence neatly removed from the system by means of a drain hose (not shown) secured to the base of channel 122.

A divider 126 in reservoir C keeps clean water in the side of the reservoir C where the valve 104 is located. Hole 127 in divider 126 provides for fluid communication between the two sides of the divider 126. During removal of the reservoir C from the housing assembly 12, the vertical drop of reservoir C after its initial forward displacement permits divider 126 to clear float 106.

Referring now in particular to FIGS. 1 and 8, the sidewall 14 defines a large central aperture 130 and a surrounding outwardly extending flange or collar 132. A conventional speed reducer 134 is seated within the collar 132 and mounted on the sidewall 14 by screws 135. The input side of the speed reducer 134 is connected to a driving member F comprising a rotatable drive shaft 142 and a plurality of fan vanes G frictionally mounted on the drive shaft 142 for rotation therewith. The output side of the speed reducer 134 is connected to a gear 146 by means of a connecting shaft 148. As the vanes G of driving member F are substantially aligned with sidewall aperture 130 and proximate to collar 132, the flow of air through aperture 130 and collar 132 causes rotation of vanes G and drive shaft 142, this rotation being translated (by means of the speed reducer 134) into a proportional but slower rotation of connecting shaft 148 and gear 146. If desired, the speed reducer 134 may be of a variable ratio type to permit the user to vary the ratio of the rotational speeds of drive shaft 142 and connecting shaft 148 in order to achieve optimum performance of the humidifier assembly.

Referring now to FIGS. 7 and 8, a rotatable water carrier subassembly E of generally drumlike configuration comprises a rotatable carrier shaft 152 having frictionally mounted, adjacent opposite ends thereof and for rotation therewith, an apertured spoked wheel 154 and a disc-like continuous wheel 156. The inner or facing surfaces of the wheels 154 and 156 are provided adjacent their peripheries with U-shaped recesses adapted to receive, and maintain therebetween by means of pin-like portions 157, a flexible hollow cylindrical hydrophilic member 158 which extends between the two wheels 154, 156 adjacent their peripheries and parallel to axis of the carrier shaft 152. The wheels 154, 156 are frictionally mounted on the carrier shaft 152 to facilitate replacement of the hydrophilic member 158. For example, one of the wheels 154, 156 may be slid entirely off the carrier shaft 152, the hydrophilic member 158 replaced, and the removed wheel then slid back onto the carrier shaft 152 to secure the hydrophilic member 158 in position, all without the use of tools, screws, or other fasteners.

Removably secured to the exposed or outer side of wheel 154 by means of screws 162 is a second gear 164, the second gear 164 thus being operably mounted on the carrier shaft 152 for rotation therewith when the carrier subassembly is fully assembled. A massive cylindrical weight 166, preferably many times the weight of the remainder of the carrier subassembly E, is frictionally mounted on the carrier shaft 152 for rotation therewith, the weight 166 being disposed along the length of carrier shaft 152 between the wheels 154, 156, but closely adjacent to the wheel 154 carrying the second gear 164. The weight 166 is preferably of small diameter relative to the diameter of the wheels 154, 156 so that the advantage of a vertical downward component adjacent the second gear 164 is obtained without unduly increasing the rotational inertia of the carrier subassembly E.

The ends of carrier shaft 152 extend outwardly from the assembled carrier subassembly E, projecting beyond the exposed surface of wheel 156 at one end and the exposed surface of the second gear 164 at the other end, to enable rotatable mounting of the carrier subassembly E within the housing assembly B. The inner surface of each sidewall 14, 16 has a generally circular, inwardly extending collar 170, 172, respectively, with three radial spokes 173 extending to the center thereof, the inner surface of one radial spoke **173*a* further defining a downwardly and rearwardly directed U-shaped recess 174 adapted to receive a projecting end of the carrier shaft 152. Each of the collars 170, 172 is flattened at the bottom and defines in the top forward quadrant thereof a gap 175 to permit passage of the second gear 164 through the collar 170, 172 during placement of the carrier subassembly E within housing assembly B. However, a removable obstructing means such as a screw 176 (see FIG. 6) is disposed in the gap 175 of one of the collars 170, 172 to insure proper positioning of the carrier subassembly E within the housing assembly B. Accordingly, the screw 176 is threadingly mounted on the collar 172 with the head disposed within the gap 175 to insure thereof that the apertured wheel 154 will be adjacent the apertured sidewall 14 by permitting passage of the second gear 164 (adjacent apertured wheel 154) through the gap 175 of the flange 170 only. To insert the assembled carrier subassembly E into the housing assembly B, it is only necessary to remove cover D with a "push in and lift" motion on handle 58, properly position the carrier subassembly E with the exposed ends of the carrier shaft 152 adjacent the recesses 174 and then release the carrier subassembly E. The carrier subassembly E will then fall downwardly and rearwardly, under the influence of gravity and directed by the downward and rearward slope of the U-shaped recesses 174, until it comes to rest adjacent the bottom of the recesses 174. At this point the bottommost segment of the hydrophilic member 158 will lie within the reservoir C, below the normal water level thereof, the unweighted end of carrier shaft 152 will rest on the bottom of one recess 174, and the gear 164 at the weighted end of the carrier shaft 152 will engage and rest on the driving gear 146 of the humidifier assembly A (which gear 146** acts as an operative connection between the driving member F and the carrier subassembly E).

Referring now to FIGS. 2–5 and 10, the humidifier assembly A is utilized in conjunction with a damper assembly I and a flexible duct J which connects the humidifier assembly A to the damper assembly I in such a manner as to permit the passage of air therebetween. The damper assembly I comprises a substantially planar damper 204 having a large central aperture therethrough, shallow rearwardly extending peripheral flanges 206, and a forwardly extending cylindrical collar 208 surrounding the damper aperture. The various flanges 206 are of equal depth, but the upper flange **206*a* defines a recess for receipt of a planar damper plate 210 having an outwardly turned grasping flange 212 on its upper edge. The damper assembly I is mounted on an apertured furnace system duct (illustrated in phantom line in FIG. 10), with the apertures of the damper 204 and the furnace system duct in alignment, by means of screws 214 passing through the corners of damper 204 into the furnace system duct in such a manner as to permit the planar portion of the damper plate 210 to pass through the recess of flange 206*a* and be frictionally maintained between the damper 204 and the furnace system duct in a range of different positions. The air flow through damper assembly I is controlled by manually adjusting the degree to which damper plate 210 closes the central aperture of damper 204 and hence limits the flow of air through the flexible duct J between the humidifier assembly A and the furnace system duct. Suitable markings may be provided on the face of the damper plate 210 to indicate the degree of closure. The flexible duct J connects collar 132 of the apertured sidewall 14 of the housing assembly B, the ends of the flexible duct J being connected to the collars 132, 208 by means of screws (not shown) passing through the ends of the flexible duct 202 and the collars 132, 208.**

Referring now in particular to FIGS. 2–5, the humidifier assembly A and the damper assembly I may be mounted on an associated hot air furnace system in a variety of different ways. The humidifier assembly A must be installed on a vertical surface of either the cold air return duct L on one side of the furnace K or the warm air supply duct M on the other side of the furnace K; however, the damper assembly I can be installed on any vertical, horizontal or inclined surface of the other furnace system duct L, M. For maximum efficiency and humidification capacity, the humidifier assembly A should be mounted on the cold air return side L and the damper assembly I on the warm air supply side M. If the humidifier assembly A is mounted on the warm air supply M and the damper assembly I on the cold air return side L, the output will be slightly reduced (about 10%) and the vanes G of driving member F must be reversed.

Referring now in particular to FIGS. 6–9, it will be noted that the sidewall 16, like sidewall 14, defines a large central aperture 130' and a surrounding outwardly extending flange or collar 132', the large central aperture 130', however, being effectively blocked by means of a window 220 secured in position on spokes 173 by means of screws 135. If it is desired to mount the flexible duct J on sidewall 16 for ease of connection to a particular furnace system configuration, it is only necessary to remove the screws 135 from each side of humidifier assembly A, interchange the window 220 and the speed reducer 134 (including driving member F), and then replace the screws 135. Naturally the water carrier subassembly E must also be reversed so that the apertured wheel 154 remains adjacent the operatively apertured sidewall (now sidewall 16). Correct placement of the water carrier subassembly E within the humidifier assembly A is enabled and insured by relocating screws 176 from its position on sidewall 16 to a corresponding position on sidewall 14. (It will be noted that at any given time, only one of the sidewalls 14, 16 is effectively apertured, the other sidewall having its central aperture 130 or 130' blocked by means of the window 220. The sidewall 14 or 16 having the aperture 130 or 130' which is not blocked by the window 220 is designated herein as the "apertured" or "operatively apertured" sidewall.)

Figure 2:
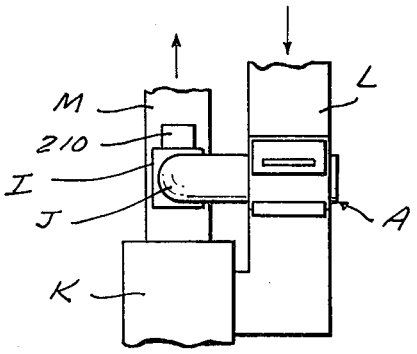
FIGS. 2–5 are fragmentary elevation views illustrating different configurations for mounting the humidifier assembly and its associated flexible duct and damper assembly on a variety of different hot air furnace systems.
Figure 3:
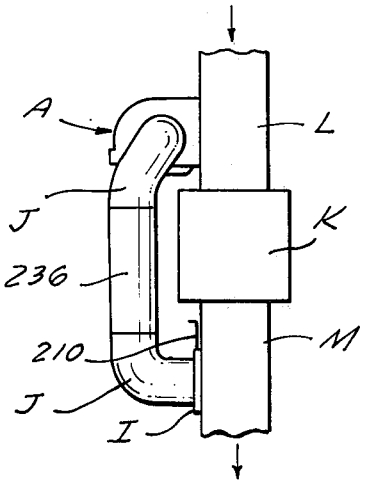
Figure 4:
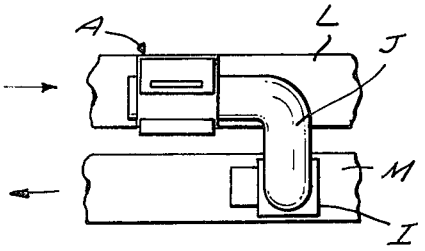
Figure 5:
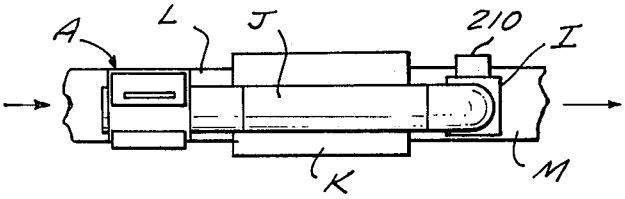

In the lowboy or hiboy system illustrated in FIG. 2, the humidifier assembly A is mounted on the cold air return duct L leading to furnace K while the damper assembly I is mounted on the warm air supply duct M leading away from the furnace K. In the counter flow system illustrated in FIG. 3, the humidifier assembly A is mounted on the cold air return L and the damper assembly I is mounted on the warm air supply M, the length of the flexible duct J being effectively extended by means of a sheet metal duct 236. In the duct mounted system illustrated in FIG. 4, the humidifier assembly A is mounted on the cold air return L, and the damper assembly I is mounted on the warm air supply M. In the horizontal system illustrated in FIG. 5, the humidifier assembly A is mounted on the cold air return L and the damper assembly I is mounted on the warm air supply M, the flexible duct J again being extended by means of a sheet metal duct 236. It will be noted that in FIGS. 3–5, the flexible duct J is mounted on the sidewall 14 of the humidifier assembly A, while in FIG. 2 the flexible duct J is mounted on the sidewall 16 and thus requires the aforementioned alterations in the internal arrangement of humidifier assembly A. In each of FIGS. 2–5 the humidifier assembly A is mounted on the cold air return L and the damper assembly I on the warm air supply M, as recommended; however, as earlier noted, the locations of the humidifier assembly A and damper assembly I may be reversed, with a slight reduction of output, providing only that the vanes G are reversed. In both cases, the pressure differential between the warm air supply (generally at a temperature of 120°–180° F. and a static pressure of 0.1 to 0.6 inches of water) and the cold air return side (generally at a temperature of 60°–75° F. and a negative pressure of 0.05 or less inches of water) is sufficient to move the air through the humidifier assembly A, thus causing rotation of vanes G and corresponding rotation of the carrier subassembly E at the desired rate of 2 to 3 revolutions per minute.

The air-driven embodiment A of FIGS. 1–9 is easily converted into the electrically-driven embodiment A' illustrated in FIG. 11. In the electrically-driven embodiment A', the driving member F (including the vanes G) and the speed reducer 134 and is associated gear 146 are eliminated from the region of the apertured sidewall 14, and an electric motor H (including a speed reducer, and a gear 146' disposed on its output shaft 148' are disposed in the region adjacent the closed sidewall 16. The motor H (including the speed reducer) are disposed externally of the glass window 220 by screws 135 securing the motor H to window 220 and the spokes 173 of the sidewall 16. Output shaft 148' passes through the window 220, and gear 146' is disposed internally of window 220. The carrier subassembly E is modified slightly during its assembly process so that wheels 154 and 156 are reversed with the disc-like wheel 156 lying between gear 164 and weight 166. The assembled water carrier subassembly E is then inserted into humidifier housing B in a reversed position, with gear 164 adjacent closed sidewall 16 and engaging the output gear 146' of motor H. In this embodiment, the motor H serves as the motive force for driving member F and acts to drive shaft 148', gear 146', gear 164, carrier shaft 152 and hence the carrier subassembly E.

In operation, the air-driven humidifier assembly A is mounted over the aperture of one of the hot air furnace system ducts (using screws passing through the keyhole apertures 20 or rear wall 18), while the damper assembly I is mounted over the aperture of the other duct (using screws 214 passing through damper 204. One end of the flexible duct J is then connected to the collar 208 of the damper assembly I, and the other end is connected to the collar 132 or 132' of the apertured sidewall 14 or 16, again using screws. Using grasping flange 212 as a handle, the damper plate 210 is then inserted into the recess of damper flange **206*a* and lowered to the desired position. The water inlet tube 102 is next threadingly connected to a water supply 116 so that water enters the reservoir C, thus elevating the float 106 until it operates a shut-off valve 104** determining the liquid flow.

Assuming that the humidifier assembly A is mounted on the cold air return duct L and the damper assembly I is mounted on the hot air supply duct M, a portion of the hot air stream passing through the hot air supply duct M at high pressure will be diverted through the damper assembly I into the flexible duct J, past the vanes G, through the internal chamber (defined by the humidifier housing assembly B, the cover D, and the reservoir C) and finally through rear wall aperture 19 into the cold air return duct L. The air stream passing the vanes G is guided by the inner collar 170 or 172 of the apertured sidewall 14 or 16 directly into the interior of the carrier subassembly E through the apertured spoked wheel 154. As the other carrier subassembly wheel 156 precludes the passage of air therethrough, the air stream entering the interior of carrier subassembly E is forced to pass through the moisture-laden hydrophilic member 158, where it becomes humidified. Under the influence of the pressure differential in the furnace system ducts, it then exits through rear wall aperture 19 into cold air return duct L. The rotation of vanes G resulting from the the passage of the air stream thereby will be communicated through the driving shaft 142, speed reducer 134 and connecting shaft 148 into rotation of housing assembly gear 146. Gear 146 in turn drives the carrier subassembly gear 164, thus causing rotation of carrier shaft 152 and the entire carrier subassembly E so that water is continually being brought up by hydrophilic member 158 from the reservoir C into the path of the air stream. Housing assembly B (including window 220), cover D, and reservoir C cooperate to form an internal chamber to substantially preclude the escape of moisture or air from the interior of humidifier assembly A axcept through the desired apertures of the rear wall 18 and apertured sidewall 14 or 16.

Operation of the electrically-driven embodiment A′ is essentially that described for the air-driven embodiment A except that rotation of the carrier subassembly E is effectuated through energization of the motor H which acts through driving shaft 148′ and gear 146′ to rotate the carrier subassembly gear 164 and thus cause rotation of the carrier subassembly E.

Figure 13:
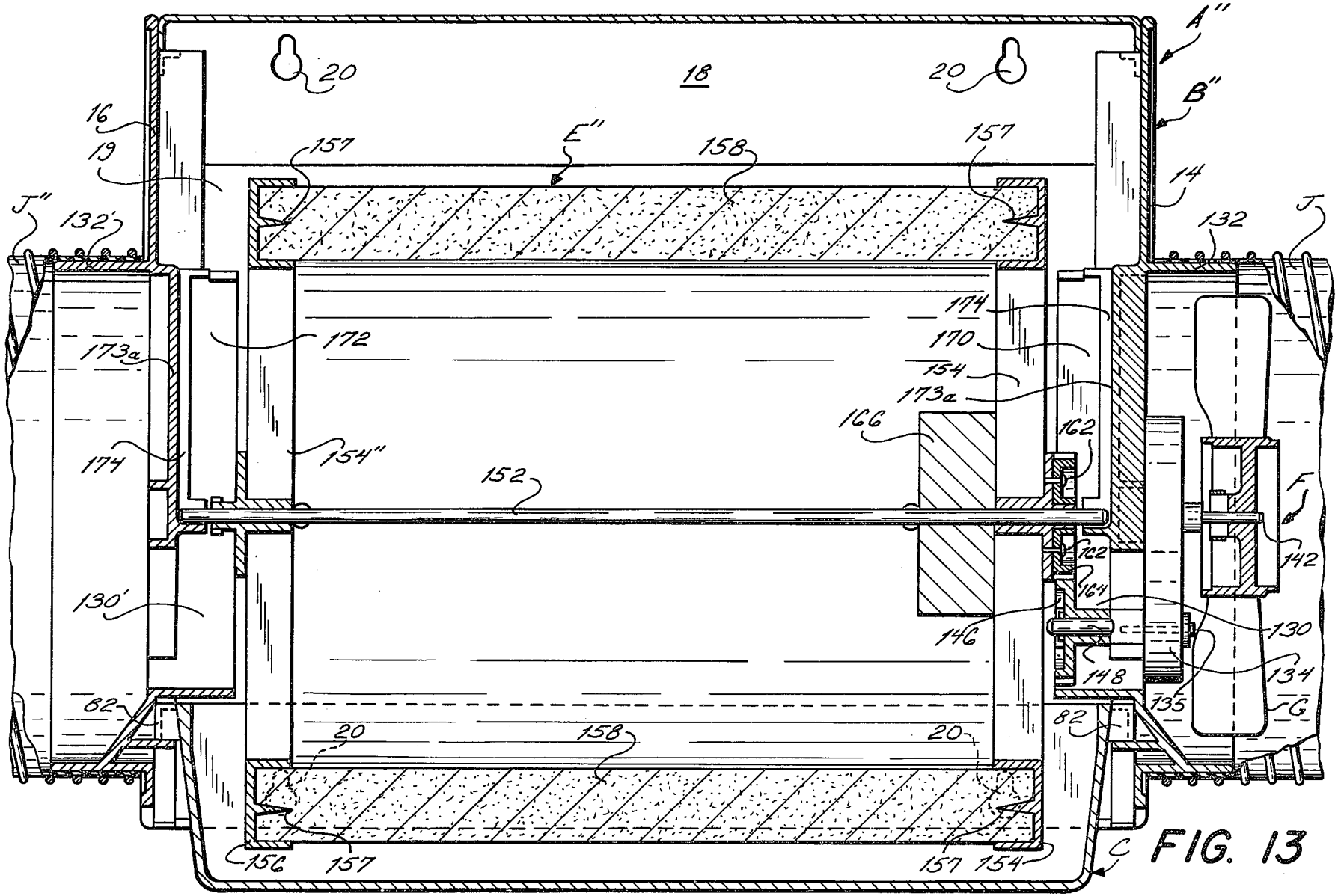
FIG. 13 is a fragmentary front elevation view, partially in cross-section, of the double bypass embodiment of the humidifier assembly of FIG. 12.

Referring now to FIGS. 12 and 13, therein illustrated is a double by-pass embodiment of the present invention which enables a much higher output of humidification based on a humidifier assembly unit of given size. Referring in particular to FIG. 13, therein illustrated is an air-driven double by-pass humidifier assembly A″ according to the present invention. The double by-pass humidifier assembly A″ is identical with the single by-pass humidifier assembly A previously described except for the absence from the housing assembly B″ of window 220 (and associated screws 135) and the substitution in the water carrier subassembly E″ of a second apertured spoked wheel 154″ for the disc-like continuous wheel 156. As a result of the removal of window 220 and the substitution of an apertured spoke wheel 154 for the closed or disc-like continuous wheel 156, a dry air stream can now be channelled through collar 132′, past apertured spoked wheel 154″ into the interior of the water carrier subassembly E″ where it joins with the dry air stream passing through collar 132 and apertured spoked wheel 154. The combined dry air stream then passes through the moisture-laden hydrophilic member 158 of the water carrier subassembly E″ and, now humidified, out of the humidifier assembly A″ through the large central aperture 19 of the rearwall 18.

It will be noted that the removal of window 220 creates an operative aperture in end wall 16 which is aligned with the operative aperture in end wall 14, while the substitution of the apertured spoked wheel 154″ for the disc-like continuous wheel 156 permits the aligned operative apertures to be in gaseous communication both with one another and with the rear wall aperture 19.

Referring now to FIG. 12, therein illustrated is a preferred configuration for mounting of the double by-pass humidifier assembly A″ and its associated flexible ducts J, J″ and damper assemblies I, I″. The configuration illustrated is similar to that of FIG. 4 (using the single by-pass humidifier assembly A) except that the second operative aperture (the one in end wall 16) is connected to the same furnace system duct (the warm air supply M) as the first operative aperture (the one in end wall 14) by means of a second flexible duct J″ connecting collar 132′ and the second damper assembly I″. The use of two damper assemblies I and I″ on the same furnace system duct effectively doubles the maximum air flow between such duct and the double by-pass humidifier assembly A″ relative to the maximum air flow using the single by-pass humidifier assembly A with a single damper assembly I.

The double by-pass embodiment A″ may also be adapted for electrical operation. In this instance, the motor H should be as small as possible to minimize interference with the flow of air through collar 132′ or, preferably, relocated so as to be disposed outside of collar 132′, but still effectively connected to shaft 148′ (as through a chain drive or gear mechanism).

To summarize, applicant has designed a humidifier assembly adaptable for either electrical or non-electrical operation. The reservoir is removed by a simple "lift, pull-out and drop" operation, while the cover is removed by a simple "push-in and lift" operation. The water carrier subassembly is removable by a simple "lift-out" motion and re-insertable with a simple "drop-in" motion, no fasteners of any sort being required to secure re-engagement of the carrier subassembly gear with the driving mechanism gear.

Now that various embodiments of the present invention have been shown and described in detail, various modifications and improvements thereon will become readily apparent to those skilled in the art. Accordingly, the spirit and scope of the present invention is to be defined not by the foregoing disclosure, but only by the appended claims.

I claim:

1. A humidifier assembly comprising:

A. a housing defining at least a pair of operative apertures and comprising a rear wall adapted to be secured to an associated hot gas heating system, a stationary front section, a movable top cover section, and end walls, said front section having an opening therein remote from said top section, said rear wall and said heating system each having a port therein, said ports being in gaseous communication with each other, said rear wall port comprising one of said operative apertures;

B. an open-topped reservoir means slidably received in said housing through said opening and accessible at the front of said housing for removal and replacement;

C. a rotatable fluid carrier subassembly rotatably received in given position in said housing between said end walls with a portion thereof adapted to contact fluid within said reservoir means via the open top thereof, said reservoir means and said fluid carrier subassembly each being removable from said housing separately from each other;

D. means for rotating said fluid carrier subassembly through at least 360°; and

E. means for operatively connecting said rotating means with said fluid carrier subassembly;

whereby gas to be humidified enters said housing through one of said apertures, passes through said fluid carrier subassembly to absorb moisture therefrom, and exits said housing through another of said apertures.

2. The humidifier assembly of claim 1, in whih said top section comprises a cover movable between top-closing and top-opening positions, said cover when in top-opening position defining a passageway through which said fluid carrier subassembly can pass, said reservoir means being removable from and insertable into said housing without dislocation of said cover from its top-closing position.

3. The humidifier assembly of claim 2, in which said cover is removable.

4. The humidifier assembly of claim 2, wherein said reservoir means is removable from and insertable into said housing without dislocation of any other element of said humidifier assembly.

5. The humidifier assembly of claim 2, in which said fluid carrier subassembly is mounted in said housing by means of structure permitting said fluid carrier subassembly to move freely at all times from said passageway to said given position and vice versa, said operative connecting means being active on said fluid carrier subassembly when the latter is in said given position and being ineffective at any time to restrict vertical movement of said fluid carrier subassembly downwardly into or upwardly from said given position.

6. The humidifier assembly of claim 5, in which said cover is removable.

7. The humidifier assembly of claim 1, in which each of said end walls has an upper surface defining a drop-in recess; said fluid carrier subassembly comprises a rotatable shaft having end segments disposed in said recesses and a gear mounted on said carrier shaft for rotation therewith; said rotating means for rotating said drive shaft; and said operative connecting means comprises a single gear operatively connected to said drive shaft for rotation therewith and positioned for meshing engagement with said carrier shaft gear when said fluid carrier subassembly is in said given position, whereby rotation of said drive shaft causes rotation of said fluid carrier subassembly.

8. The humidifier assembly embodiment of claim 7, wherein one of said end walls defines a first one of said operative apertures, and wherein said drive means comprises vanes carried by said drive shaft adjacent to said one end wall and aligned with said first operative aperture, whereby said drive shaft is rotated responsive to the passage of gas through said first operative aperture.

9. The humidifier assembly of claim 8, wherein the other of said end walls defines a third operative aperture in gaseous communication with said first operative aperture only through said fluid carrier subassembly.

10. The humidifier assembly of claim 7, further including a gear reduction system operatively connecting said drive shaft and said drive shaft gear.

11. The humidifier assembly of claim 7, wherein the axis of said operative connecting means gear is spaced below the axes of said drive shaft and said carrier shaft gear.

12. The humidifier assembly of claim 7, wherein said drive means comprises an electric motor.

13. The humidifier assembly of claim 7, wherein said fluid carrier subassembly further includes a weight disposed on said carrier shaft adjacent said carrier shaft gear.

14. The humidifier assembly of claim 7, wherein said fluid carrier subassembly is positioned exclusively by means of said recesses and said operative connecting means gear, and is in physical contact exclusively with the fluid, said recesses and said operative connecting means gear.

15. A humidifier assembly comprising:

A. a housing defining at least a pair of operative apertures for the passage of gas therethrough comprising oppositely disposed and spaced end walls, a connecting rear wall therebetween adapted to be secured to a hot gas heating system, and a front section having an opening therein;

B. an open-topped reservoir means slidably received in said housing in a given position through said opening and accessible at the front of said housing for removal and replacement;

C. a rotatable fluid carrier subassembly rotatably received in a given position in said housing between said end walls with a portion thereof adapted to contact fluid within said reservoir means via the open top therefore, said reservoir means and said fluid carrier subassembly each being removable from said housing separately from each other;

D. means for rotating said fluid carrier subassembly; and

E. means for operatively connecting said rotating means with said fluid carrier subassembly, said reservoir means including an outwardly extending flange and said housing including an inwardly extending flange, said reservoir flange being supported by said housing flange when said reservoir is in said given reservoir position and adapted to fall downwardly past said housing flange for removal and replacement of said reservoir means when horizontally displaced from said housing flange by a horizontal displacement insufficient either to dislocate said fluid carrier subassembly from said given subassembly position or to reposition said reservoir in its entirety in front of said front section;

whereby gas to be humidified enters said housing through one of said apertures, passes through said fluid carrier subassembly to absorb moisture therefrom, and exits said housing through another of said apertures.

16. The assembly of claim 15 wherein said reservoir means includes at least one outwardly extending flange on each end wall thereof, said housing includes at least a spaced pair of inwardly extending flanges on each end wall thereof, said reservoir flanges being capable of passing intermediate said housing flange pairs.

17. The assembly of claim 15 wherein said reservoir means includes at least a spaced pair of outwardly extending flanges on each end wall thereof and said housing includes at least a spaced pair of inwardly extending flanges on each end wall thereof.

18. A humidifier assembly comprising:

A. a housing assembly for use with an associated hot gas heating system, said housing assembly comprising oppositely disposed and spaced end support walls and connecting front and rear walls therebetween, said housing assembly defining a pair of operative apertures for gaseous communication with the heating system, said front wall having an opening therein remote from the top thereof, said rear wall and said heating system each having a port therein, said ports being in gaseous communication with each other, said rear wall port comprising one of said operative apertures, said end walls each having an upper surface defining a drop-in recess;

B. reservoir means, said reservoir means being slidably received in said housing assembly through said opening and accessible at the front of said housing for removal and replacement for the storage of fluid;

C. cover means positioned on said housing assembly adjacent the top thereof and defining with said housing assembly and said reservoir an interior chamber communicating with said operative apertures;

D. a driving member secured to one of said end walls and comprising a rotatable drive shaft and drive means for rotating said drive shaft;

E. a first gear disposed within said chamber and operatively connected to said drive shaft for rotation therewith; and F. a rotatable fluid carrier subassembly removably positioned in a given position within said chamber so as to have a portion thereof contacting the fluid within said reservoir means, said carrier subassembly comprising a rotatable shaft, at least one hydrophilic member carried by and spaced from said carrier shaft for rotation therewith, and a second gear mounted on said carrier shaft for rotation therewith and in meshing engagement only with said first gear, said carrier subassembly being positioned in said given position within said chamber by the receipt of end segments of said carrier shaft within said recesses, said recesses and said gears being ineffective at any time to restrict movement of said carrier subassembly upwardly from or downwardly into said given position and said carrier subassembly being removable from said housing assembly and insertable into said given position without interference of any element of said humidifier assembly except said cover means; whereby rotation of said drive shaft causes rotation of said carrier subassembly and gas passing between said operative apertures passes through said hydrophilic member and absorbs moisture therefrom.

19. The humidifier assembly of claim 18, wherein said rear wall and one of said end walls each define one of said operative apertures, and wherein said drive means comprises vanes carried by said drive shaft adjacent to said operatively apertured end wall and aligned with said end wall operative aperture, whereby said drive shaft is rotated responsive to the passage of gas through said end wall operative aperture.

20. The humidifier assembly of claim 19, wherein the other of said end walls defines a third operative aperture aligned with and in gaseous communication with said end wall operative aperture only through said fluid carrier subassembly.

21. The humidifier assembly of claim 18, further including a gear reduction system operatively connecting said drive shaft and said first gear.

22. The humidifier assembly of claim 18, wherein the axis of said first gear is spaced from the axes of said drive shaft and said carrier shaft.

23. The humidifier assembly of claim 18, wherein said carrier subassembly further includes a weight disposed on said carrier shaft adjacent said second gear.

24. The humidifier assembly of claim 18, wherein said carrier subassembly is positioned in said chamber exclusively by means of said recesses and said first gear, and is in physical contact exclusively with the fluid, said recesses and said first gear.

25. The humidifier assembly of claim 18, wherein said rear wall and one of said end walls each define one of said pair of operative apertures, and wherein said drive means comprises a motor operatively connected to said drive shaft adjacent to the other of said end walls.

26. The humidifier assembly of claim 25, wherein the other of said end walls defines a third operative aperture aligned with said end wall operative aperture and in gaseous communication with said end wall operative aperture only through said fluid carrier subassembly.

27. The humidifier assembly of claim 18, wherein said cover means is removable from said housing assembly to define a passageway in said housing assembly for passage therethrough of said carrier subassembly.

28. The humidifier assembly of claim 27, wherein said cover means comprises a convexly bowed sheet of resiliently flexible material having a forwardly facing flange at both ends.

29. The humidifier assembly of claim 28, wherein said housing assembly further comprises a top section having a downwardly extending flange and a front section having a rearwardly extending flange, said top and front section flanges being positioned to engage said cover means flanges and maintain said cover means in a position on said housing assembly closing said passageway in the absence of further bowing of said cover means.

* * * * *